US005264839A

United States Patent [19]

Kanno et al.

[11] Patent Number: 5,264,839

[45] Date of Patent: Nov. 23, 1993

[54] DISPLAY APPARATUS

[75] Inventors: Hideo Kanno, Kawasaki; Hiroshi Inoue, Yokohama; Atsushi Mizutome, Tokyo, all of Japan

[73] Assignee: Canon Kabushiki Kaisha, Tokyo, Japan

[21] Appl. No.: 3,868

[22] Filed: Jan. 11, 1993

Related U.S. Application Data

[63] Continuation of Ser. No. 718,905, Jun. 24, 1991, abandoned, which is a continuation of Ser. No. 248,043, Sep. 23, 1988, abandoned.

[30] Foreign Application Priority Data

Sep. 25, 1987 [JP] Japan ..... 62-238924

[51] Int. Cl.[5] ..... G09G 3/36

[52] U.S. Cl. ..... 345/98; 345/185

[58] Field of Search ..... 340/784, 783, 805, 811, 340/765; 358/241, 236; 359/54

[56] References Cited

U.S. PATENT DOCUMENTS 4,556,880 12/1985 Hamada ..... 340/784
4,655,561 4/1987 Kanbe .
4,709,995 12/1987 Karibayashi ..... 350/350 S

FOREIGN PATENT DOCUMENTS 0236767 9/1987 European Pat. Off. .
0256879 2/1988 European Pat. Off. ..... 340/784

*Primary Examiner*—Alvin E. Oberley
*Assistant Examiner*—Doom Yue Chow
*Attorney, Agent, or Firm*—Fitzpatrick, Cella, Harper & Scinto

[57] ABSTRACT

A display apparatus includes: a) a matrix electrode structure comprising a set of plural scanning electrodes and a set of plural data electrodes intersecting with the scanning electrodes; b) a scanning electrode driver for serially applying a scanning selection signal to the scanning electrodes and a data electrode driver for applying data signals in parallel; c) an address generator for serially generating an address signal for addressing a scanning electrode to which the scanning selection signal is to be applied and image signals for directing data signals to be sent to the data electrodes to the respective data electrodes; and d) a circuit for generating a signal for directing a changeover between a transfer of the address signal to the scanning electrode driver and a transfer of the image signals to the data electrode driver. The display apparatus is particularly adapted for partial rewriting.

8 Claims, 3 Drawing Sheets

DISPLAY APPARATUS

This application is a continuation of application Ser. No. 07/718,905 filed Jun. 24, 1991, now abandoned, which is a continuation of application Ser. No. 07/248,043 filed Sep. 23, 1988, abandoned.

FIELD OF THE INVENTION AND RELATED ART

The present invention relates to a display apparatus, more particularly a display apparatus comprising a ferroelectric liquid crystal panel.

In a conventional display apparatus, e.g., a liquid crystal display apparatus comprising scanning electrodes and data electrodes arranged to form a matrix and a liquid crystal disposed between the scanning electrodes and data electrodes to form a large number of pixels for image display, there is used a driving method wherein a scanning signal is sequentially applied to the scanning electrodes and image signals are applied to the data electrodes in synchronism with the scanning signal. Particularly, for driving a ferroelectric liquid crystal panel, a scanning selection signal defining at least two phases is serially applied to the scanning electrodes so as to apply a voltage to a pixel on a selected scanning electrode for providing a white (or black) state at the pixel in one phase and apply a voltage to a pixel on the selected scanning electrode for providing a black (or white) state at the pixel in another phase, and one frame or field of picture is formed by one vertical scanning. Details of such a driving system are disclosed in U.S. Pat. No. 4,655,561.

Conventionally, a scanning electrode drive circuit and a data electrode drive circuit of a nematic liquid crystal panel have been controlled by control signals including a vertical synchronizing signal VD, a horizontal synchronizing signal HD, and image or data signals as shown in FIG. 4. The vertical scanning signal VD is a signal for defining one frame scan (corresponding to one frame period) with a scanning selection signal and is periodically outputted. The horizontal scanning signal HD is a signal for defining a period for one selection of a scanning electrode during which image signals corresponding to the number of data electrodes are serially transferred to the data electrode drive circuit.

In a control system using such three types of signals, when a vertical synchronizing pulse VD is applied, a first scanning electrode of the panel or screen is selected, and the scanning is started from the first scanning electrode and sequentially continued to the lowest scanning electrode, while horizontal synchronizing pulses HD are applied. In parallel with the scanning image data are transferred to the data electrode drive circuit so as to output one set of data signals in one selection period for a scanning electrode. The above operation is repeated 30 times per second (30 frames/sec; frame frequency: 1/30 sec) or more.

In this instance, in case where a display panel of a large size having a large number of pixels is driven at a frequency of 30 frames or more per sec, the frequencies of the VD, HD and image data signals are naturally increased correspondingly. For example, in case where a display panel having 400 scanning electrodes is driven at a frequency of 30 frames/sec., the 1H period required becomes about 80 μsec.

However, where a ferroelectric liquid crystal is considered as a liquid crystal material for such a display panel, no practical ferroelectric liquid crystal capable of being written with a desired pulse in the 1H period of about 80 μsec. On the other hand, when the above-mentioned control method is used by a desired pulse with a 1H period of longer than 80 μsec, the resultant frame frequency becomes lower than 30 frames per sec and provides a scanning state which is noticeable to human eyes and is problematic in display. Further, the scanning electrodes are sequentially scanned and all the data electrodes are always supplied with data signals in synchronism with the scanning signal, so that a large power consumption is required.

U.S. Pat. No. 4,655,561 further discloses a partial rewriting mode wherein a prescribed part of a picture is rewritten by driving only the scanning electrodes in the rewriting region. In order to apply the partial rewriting mode to the above-mentioned control method, the scanning electrodes subjected to partial rewriting must be controlled by a scanning start signal and a scanning finish signal, so that the circuit designing becomes complicated.

SUMMARY OF THE INVENTION

An object of the present invention is to provide a display apparatus which has solved the abovementioned problems of the conventional system and is capable of providing an apparently faster response and a lower power consumption of a display panel of a large area and a large number of pixels.

Another object of the present invention is to provide a display apparatus which allows for partial rewriting by using a mouse display, a cursor display and a multi-window display.

According to the present invention, there is provided a display apparatus, comprising:

a) a matrix electrode structure comprising a set of plural scanning electrodes and a set of plural data electrodes intersecting with the scanning electrodes;

b) scanning electrode drive means for serially applying a scanning selection signal to the scanning electrodes and data electrode drive means for applying data signals in parallel;

c) means for serially generating an address signal for addressing a scanning electrode to which the scanning selection signal is to be applied and image signals for directing data signals to be sent to the data electrodes to the respective data electrodes; and d) means for generating a signal for directing a changeover between a transfer of the address signal to the scanning electrode drive means and a transfer of the image signals to the data electrode drive means.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
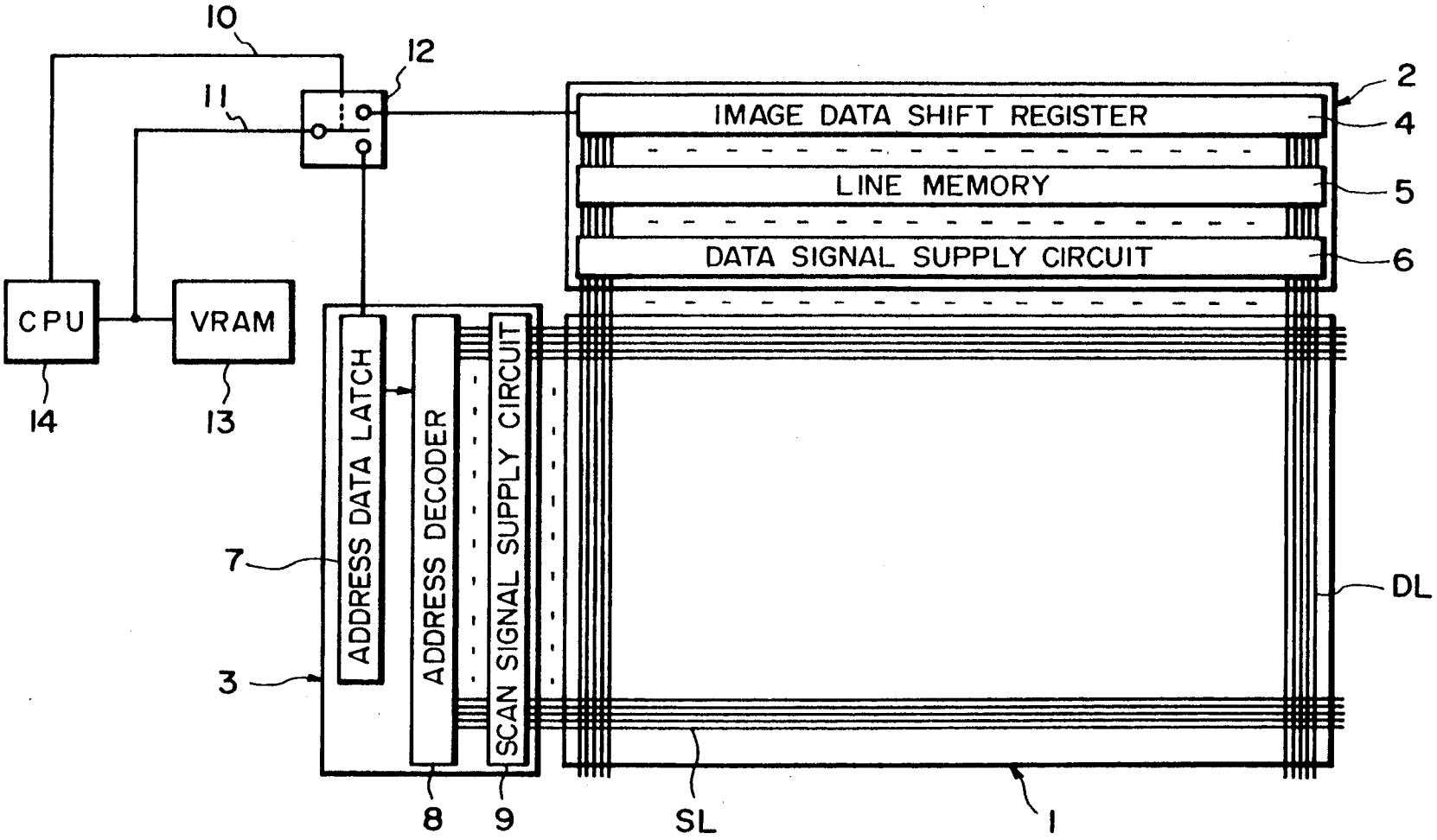
FIG. 1 is a block diagram of a display apparatus according to the present invention.

FIG. 1 illustrates an outline of a display apparatus including a display panel 1 and peripheral circuits used in the present invention. The display panel 1 comprises data electrodes DL (e.g., 640 lines), scanning electrodes SL (e.g., 400 lines) and a ferroelectric liquid crystal hermetically disposed therebetween. The data electrodes DL are supplied with data signals from a data electrode drive circuit 2, and the scanning electrodes SL are supplied with data signals from a scanning electrode drive circuit 3. The data electrode drive circuit 2 includes a shift register 4 receiving one line of image signal data shown in FIG. 2 serially supplied to be displayed on the display panel 1; a line memory 5 receiving in parallel and memorizing the serial data for one line sent to the shift register 4; and a data signal supply circuit 6 for supplying data signals to the respective data electrodes DL according to the data for one line memorized in the line memory 5.

The scanning electrode drive circuit 3 includes an address data latch 7 for latching an address signal for designating one of the scanning electrodes SL; an address decoder 8 for selecting one of the scanning electrodes SL according to the address signal latched by the address data latch 7; and a scanning signal supply circuit 9 for supplying a scanning selection signal to one scanning electrode SL selected by the address decoder 8.

Figure 2:
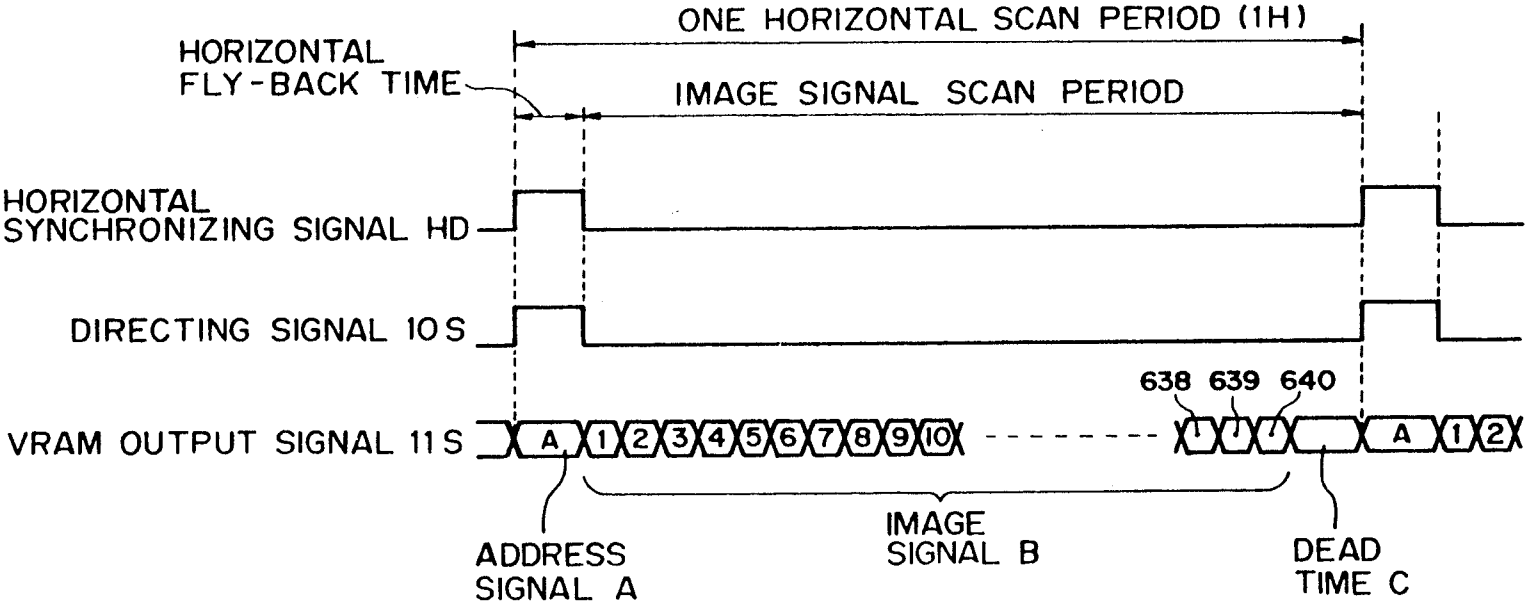
FIG. 2 is a time chart for a VRAM output signal, a directing signal and a horizontal synchronizing signal.

The display apparatus further includes an image memory VRAM 13 for memorizing image data for each of the bits corresponding to the pixels formed at the intersection of the data electrodes DL and the scanning electrodes SL on the display panel 1; a changeover directing signal line 10 for supplying a horizontal synchronizing signal; an address data line 11 for transferring output signals (VRAM output signals shown in FIG. 2) from the image memory (VRAM) 13 to the display panel 1; a changeover switch 12 for determining either the shift register 4 or the address data latch 7 to which the VRAM output signals from the address data line 11 are to be sent depending on the signal (horizontal synchronizing signal) from the changeover directing signal line 10. According to the present invention, as shown in FIG. 2, the VRAM output signals include an address signal A for addressing a scanning electrode to which a scanning selection signal is to be sent, and image signals B for designating data signals to be supplied to the data electrodes for the respective data electrodes. By the action of the switch 12, the address signal A is transferred to the address data latch 7, and the image signals B are set to the shift register 4.

The display apparatus further includes a CPU 14 by which the outputs from the image memory 13 are controlled. Particularly when partial rewriting data are generated in the image memory 14, the CPU 14 reads out the order of scanning electrodes to be addressed from the partial rewriting data corresponding to the rewriting lines and supplies the address signal A thereto.

Next, a signal transfer system by using the above display apparatus will be explained.

FIG. 2 is a time chart showing a directing signal 10S appearing on the changeover directing signal line 10 and VRAM output signals 11S appearing on the address data line 11.

When the directing signal 10S is at the high level, the VRAM output signal 11S comprises an address signal A for designating one of the scanning electrodes SL. Thereafter, when the directing signal 10S is at the low level, the address data line 11 serially transfers VRAM output signals 11S which are image signals B serially outputted in the image signal scanning period, i.e., data signals each corresponding to one of the data electrodes DL. Before the time when the changeover directing signal 11S is at the high level again, a period called "dead time C" is placed, which is a very short time allotted as a process time for an external transfer apparatus.

When the directing signal 10S is at the high level, the switch 12 turns the address data line 11 over to the address data latch 7 side. As a result, the address signal A in the VRAM output signals 11S is latched by the address data latch 7, and a scanning selection signal is supplied to one of the scanning electrodes SL through the address decoder 8 and the scanning signal supply circuit 9.

Then, when the directing signal 10S is at the low level, the switch 12 turns the address data line 11 over to the shift register 4 side. As a result, the image signals in the VRAM output signals 11S are supplied to the shift register 4 and sent through the line memory 5 to the data signal supply circuit 6, from which a white data signal and a black data signal are supplied to the respective data electrodes DL selectively depending on given data. In other words, an address signal A sent to the scanning electrode drive circuit 3 and serial image signals B sent to the data electrode drive circuit 2 may be supplied to one address data line 11, so that the address signal A for addressing a selected scanning electrode is conveyed first, and subsequently thereafter the image signals B corresponding to the selected scanning electrode may be sent to the data electrodes. A similar control may be repeated for the subsequent second, third, . . . , scanning electrodes, whereby one picture may be formed.

In a preferred embodiment of the present invention, when a part of an already formed display picture is rewritten (e.g., for correction of a character or a multi-window display on a display picture), the above-mentioned address signal A may be controlled by the CPU so that the address signal A is supplied to only scanning electrodes in the partially rewritten region. Further, such a partial rewriting scheme by applying a scanning selection signal only to a selected scanning electrode may also be applicable to a cursor display or mouse display on a display picture.

Referring again to FIG. 2, the directing signal 10S is synchronized with the horizontal synchronizing signal HD, and the high level of 10S is allotted to the horizontal fly-back time and the low level thereof is allotted to the image signal scanning period, with respect to time. Further, the image data 1, 2, 3, 4, . . . , 640 serially supplied in one horizontal scanning period correspond to image data of data signals sent to the first, second, third, fourth, . . . , 640-th data electrodes, respectively.

Figure 3:
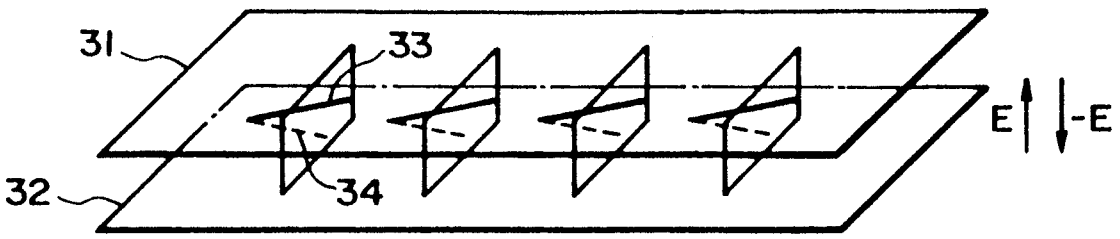
FIG. 3 is a schematic perspective view of a memory-type ferroelectric liquid crystal device.
Figure 4:
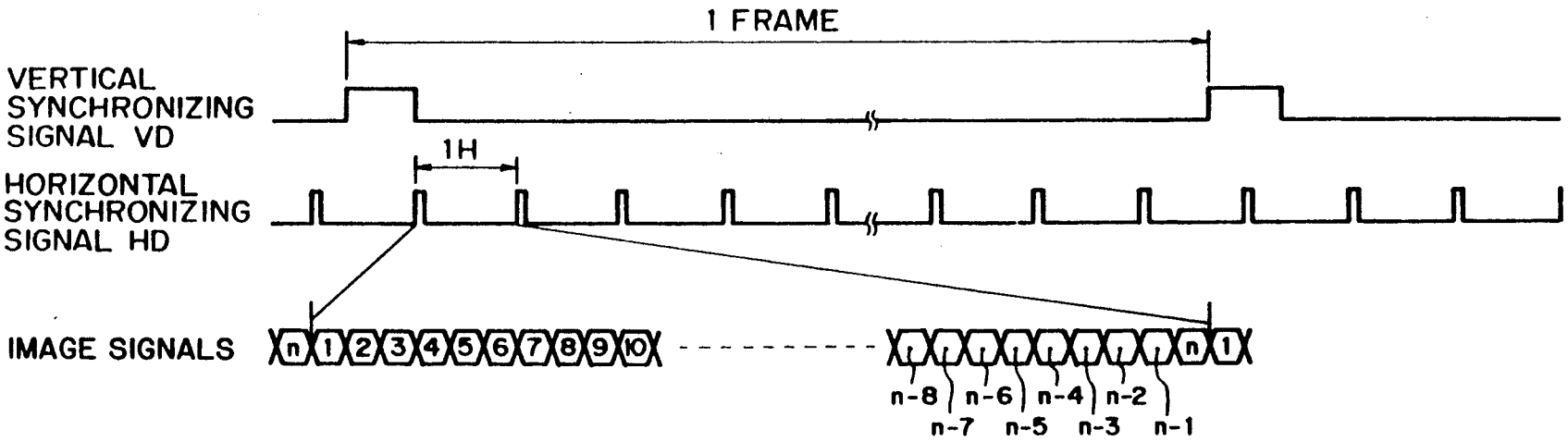
FIG. 4 PRIOR ART
FIG. 4 is a time chart for a VRAM output signal, a horizontal synchronizing signal and a vertical synchronizing signal in a conventional system.

Incidentally, in order to effect partial writing, a liquid crystal material and a liquid crystal cell are required to have a memory characteristic. Hereinbelow, the memory characteristic of a ferroelectric liquid crystal is supplemented. As shown in FIG. 3, when a ferroelectric liquid crystal is disposed between upper and lower electrode plates 31 and 32, and is supplied with an electric field exceeding a certain threshold, a liquid crystal molecule thereof is oriented to a first stable state which is retained even after the removal of the electric field E. On the other hand, when a reverse electric field −E is applied, the liquid crystal molecule is oriented to a second stable state 34 which is also retained even after the removal of the electric field −E. Further, the respective orientation states are retained unless the electric field E or −E applied thereto does not exceed such a certain threshold value.

By utilizing the above characteristic, the orientation of a ferroelectric liquid crystal at an intersection of a data electrode DL and a scanning electrode SL can be changed by an electric field given by voltage applied to the data electrode and the scanning electrode and the resultant orientation is maintained even after removal of the voltages.

As described hereinabove, according to the present invention, for effecting such a partial writing (rewriting) operation, it is possible to provide an apparently faster response speed to a ferroelectric liquid crystal panel of a large area and a large number of pixels using a ferroelectric liquid crystal which does not satisfy a desired response speed. Further, by partial writing (or rewriting) operation, the number of scanning electrodes to be scanned can be minimized, and the operation can be effected instantaneously, so that the power consumption can also be minimized. Further, according to the present invention, the use of a conventionally used vertical synchronizing signal can be omitted.

What is claimed is:

1. A display apparatus, comprising:

a) a matrix electrode structure comprising a set of plural scanning electrodes and a set of plural data electrodes intersecting with the scanning electrodes;

b) memory means for serially generating address signal data for designating a scanning electrode to which a scanning selection signal is to be applied and image signal data for displaying an image on the matrix electrode structure and for serially transferring the address signal data and the image signal data to a common line, whereby the address signal data is synchronized with a horizontal flyback time in one horizontal scanning period;

c) scanning electrode drive means for serially applying the scanning selection signal to the scanning electrodes, said scanning electrode drive means comprising a latch for latching the address signal data and a decoder for selecting one of the scanning electrodes according to the address signal data latched by the latch;

d) data electrode drive means for applying to the data electrodes in parallel data signals in accordance with the image signal data, said data electrode drive means comprising a shift register receiving the image signal data;

e) means for generating a changeover signal for directing a changeover between a transfer of the address signal data and a transfer of the image signal data, respectively supplied from the common line; and f) means for switching in accordance with the changeover signal between the transfer of the address signal data and the transfer of the image signal data such that the address signal data is transferred to the latch and the image signal data is transferred to the shift register.

2. An apparatus according to claim 1, wherein said transfer of the address signal to the scanning electrode drive means is synchronized with a horizontal scanning signal defining one horizontal scanning period.

3. An apparatus according to claim 1, wherein a liquid crystal is disposed between the intersections of the scanning electrodes and the data electrodes.

4. An apparatus according to claim 3, wherein said liquid crystal comprises a ferroelectric liquid crystal.

5. A display apparatus, comprising:

a) a matrix electrode structure comprising a set of plural scanning electrodes and a set of plural data electrodes intersecting with the scanning electrodes;

b) memory means for serially generating address signal data for designating scanning electrodes such that a scanning selection signal is applied to only scanning electrodes in a rewriting region and image signal data for displaying a rewriting image on the matrix electrode structure, and for serially transferring the address signal data and the image signal data to a common line, whereby the address signal data is synchronized with a horizontal flyback time in one horizontal scanning period;

c) scanning electrode drive means for serially applying the scanning selection signal to the scanning electrodes, said scanning electrode drive means comprising a latch for latching the address signal data and a decoder for selecting one of the scanning electrodes according to the address signal data latched by the latch;

d) data electrode drive means for applying to the data electrodes in parallel data signals in accordance with the image signal data, said data electrode drive means comprising a shift register receiving the image signal data;

e) means for generating a changeover signal for directing a changeover between a transfer of the address signal data and a transfer of the image signal data, respectively supplied from the common line; and f) means for switching in accordance with the changeover signal between the transfer of the address signal data and the transfer of the image signal data such that the address signal data is transferred to the latch and the image signal data is transferred to the shift register.

6. An apparatus according to claim 5, wherein said transfer of the address signal to the scanning electrode drive means is synchronized with a horizontal scanning signal defining one horizontal scanning period.

7. An apparatus according to claim 5, wherein a liquid crystal is disposed between the intersections of the scanning electrodes and the data electrodes.

8. An apparatus according to claim 7, wherein said liquid crystal comprises a ferroelectric liquid crystal.

* * * * *